United States Patent [19]

Ferguson

[11] Patent Number: 4,545,770

[45] Date of Patent: Oct. 8, 1985

[54] OUTBOARD MOTOR MOUNTING ARRANGEMENT

[75] Inventor: Arthur R. Ferguson, Northbrook, Ill.

[73] Assignee: Outboard Marine Corporation, Waukegan, Ill.

[21] Appl. No.: 605,141

[22] Filed: Apr. 30, 1984

Related U.S. Application Data

[63] Continuation of Ser. No. 293,324, Aug. 17, 1981, Pat. No. 4,449,945.

[51] Int. Cl.[4] ..... B63H 21/26

[52] U.S. Cl. ..... 440/61; 440/63

[58] Field of Search ..... 440/42, 43, 53, 57–63; 114/144 R, 150; 248/640–643; 74/480 B

[56] References Cited

U.S. PATENT DOCUMENTS

| | | | |
|---|---|---|---|
| 2,916,008 | 12/1959 | Bauer | 440/61 |
| 2,928,631 | 3/1960 | Hartman | 440/59 |
| 2,939,417 | 6/1960 | Hammock, Sr. | 114/150 |
| 3,091,977 | 6/1963 | Kiekhaefer | 440/62 |
| 3,095,849 | 7/1963 | Breunich | 440/60 |
| 3,116,710 | 1/1964 | Cass | 440/61 |
| 3,631,833 | 1/1972 | Shimanckas | 440/55 |
| 3,774,568 | 11/1973 | Borst et al. | 114/144 R |
| 4,054,102 | 10/1977 | Borst et al. | 114/144 R |
| 4,373,920 | 2/1983 | Hall et al. | 440/59 |

FOREIGN PATENT DOCUMENTS

| | | | |
|---|---|---|---|
| 1214853 | 12/1970 | United Kingdom | 440/61 |

*Primary Examiner*—Trygve M. Blix
*Assistant Examiner*—Stephen P. Avila
*Attorney, Agent, or Firm*—Michael, Best & Friedrich

[57] ABSTRACT

Disclosed herein is a marine propulsion installation comprising a marine propulsion device including a transom bracket having a mounting portion fixed to the rear of a boat transom below the upper edge thereof, and a pair of laterally spaced arms extending upwardly from the mounting portion and including respective upper ends located rearwardly of the boat transom and above the upper edge thereof, a swivel bracket comprising a mounting portion and a pair of laterally spaced arms extending upwardly from the swivel bracket mounting portion and including respective upper ends, a tilt pin connecting the upper ends of the transom bracket and swivel bracket arms to provide for pivotal movement of the swivel bracket relative to the transom bracket about a tilt axis which is horizontally located rearwardly of the transom and above the upper edge thereof, a propulsion unit including an internal combustion engine and a propeller mounted for rotation and driven by the engine, and a king pin connecting the propulsion unit to the swivel bracket mounting portion for pivotal steering movement of the propulsion unit relative to the swivel bracket about a second axis transverse to the tilt axis and for common movement of the propulsion unit with the swivel bracket about the tilt axis and without travel of the propulsion unit over the transom upper edge or into engagement with the transom.

3 Claims, 7 Drawing Figures

OUTBOARD MOTOR MOUNTING ARRANGEMENT

RELATED APPLICATION

This is a continuation of application Ser. No. 292,324, filed Aug. 17, 1981, now U.S. Pat. No. 4,449,945, issued May 22, 1984.

BACKGROUND OF THE INVENTION

The invention relates generally to marine propulsion devices, such as stern drive units and outboard motors. More particularly, the invention relates to outboard motor mounting arrangements which prevent travel of a propulsion unit forwardly over the transom, or into engagement with the transom.

Attention is directed to the co-pending Stevens application Ser. No. 159,480, filed June 16, 1980, and entitled "Outboard Motor With Elevated Horizontal Pivot Axis", now U.S. Pat. No. 4,355,986 issued Oct. 26, 1982.

Attention is also directed to the co-pending Blanchard application Ser. No. 167,337, filed July 9, 1980, and entitled "Outboard Motor With Dual Trim and Tilt Axis", now U.S. Pat. No. 4,406,632 issued Sept. 27, 1983.

Attention is also directed to the co-pending Strang application Ser. No. 190,589, filed Sept. 25, 1980, and entitled "High Pivot Transom Bracket Assembly for Mounting Outboard Motor", now U.S. Pat. No. 4,367,860 issued Jan. 11, 1983.

Attention is also directed to the U.S. Skimanckas Pat. No. 3,269,351, issued Aug. 30, 1966.

The invention also relates to arrangements for steering the propulsion unit of a marine propulsion device. Attention is directed to the following U.S. Pat. Nos.:

Skimanckas: 3,631,833, issued Jan. 4, 1972
Borst: 3,774,568, issued Nov. 27, 1973
Borst: 4,054,102, issued Oct. 18, 1977
Hammock: 2,939,417, issued June 7, 1960

In addition, attention is directed to the co-pending Hall application Ser. No. 173,158, filed July 28, 1980, and entitled "Marine Propulsion Device Steering Mechanism", now U.S. Pat. No. 4,373,920 issued Feb. 15, 1983.

The invention also relates to arrangements for trimming and tilting the propulsion unit of a marine propulsion device.

Attention is directed to the following U.S. Pat. Nos.:

Carpenter: 3,722,455, issued Mar. 27, 1973
Shimanckas: 3,847,198, issued Nov. 12, 1974
Borst: 3,863,592, issued Feb. 4, 1975
Borst: 3,885,517, issued May 27, 1975
Hall: 3,983,835, issued Oct. 5, 1975
Hall: 4,064,824, issued Dec. 27, 1977
Hall: 4,096,820, issued June 27, 1978

Attention is also directed to the co-pending Hall application Ser. No. 173,160, filed July 28, 1980, and entitled "Outboard Motor with Sequentially Operating Tilt and Trim Means", now U.S. Pat. No. 4,373,921 issued Feb. 15, 1983.

The invention also relates to arrangements for passing control lines or cables and/or fluid lines or conduits through a transom now U.S. Pat. No. 4,371,348 issued Feb. 1, 1983 to a marine propulsion device.

Attention is directed to the co-pending Blanchard application Ser. No. 188,323, filed Sept. 18, 1980, and entitled "Mounting For Marine Propulsion Device Located Aft of Boat Transom", now U.S. Pat. No. 4,371,348 issued Feb. 1, 1983.

Attention is also directed to the Stevens application Ser. No. 190,387, filed Sept. 24, 1980, and entitled "Arrangement for Supplying Air, Fuel, Power and Control Cables to a Marine Propulsion Unit", now U.S. Pat. No. 4,375,356 issued Mar. 1, 1983.

The invention also relates to arrangements for indicating the tilt angle of a propulsion unit. Attention is directed to the Meyer U.S. Pat. No. 3,844,247 issued Oct. 29, 1974 and to the Lambrecht U.S. Pat. No. 3,722,456 issued Mar. 27, 1973.

SUMMARY OF THE INVENTION

The invention provides a marine propulsion device comprising a transom bracket including a portion adapted for mounting to the rear of a boat transom, and a pair of laterally spaced arms extending upwardly from the mounting portion and including respective upper ends, a swivel bracket comprising a lower propulsion unit mounting portion and a pair of laterally spaced arms extending upwardly from the swivel bracket mounting portion and including respective upper ends, means adjacent the upper ends of the transom bracket arms and adjacent the upper ends of the swivel bracket arms for mounting the swivel bracket to the transom bracket for pivotal movement about a tilt axis which is horizontal when the transom bracket is boat mounted and relative to a running position with the swivel bracket mounting portion located adjacent the transom bracket mounting portion, a propulsion unit including an internal combustion engine and a propeller mounted for rotation and driven by the engine, and means connecting the propulsion unit to the mounting portion of the swivel bracket for common movement of the propulsion unit with the swivel bracket about the tilt axis and for pivotal steering movement of the propulsion unit relative to the swivel bracket about a second axis transverse to the tilt axis.

In one embodiment of the invention, the transom bracket includes a pair of laterally spaced members which respectively include lower portions having a lower end, and a forward part, which forward parts of the lower portions of the transom bracket members comprise the mounting portion, wherein the transom bracket arms respectively form parts of the transom bracket members and respectively extend upwardly from the forward parts of the lower portions, wherein the transom bracket further includes a top wall joining the upper ends of the arms, and wherein the transom bracket further includes a bottom wall joining the lower ends of the members, whereby the transom bracket constitutes a box-like frame, wherein the swivel bracket includes a pair of laterally spaced members which respectively include lower portions having a lower end, a forward part, and a rearward part, wherein the swivel bracket arms respectively form parts of the swivel bracket members and respectively extend upwardly from the forward parts of the lower portions of the swivel bracket members, wherein the swivel bracket further includes a bottom wall joining the lower ends of the swivel bracket members, whereby the swivel bracket constitutes, in part, a U-shape frame, wherein the swivel bracket further includes a swivel block constituting the mounting portion and connected to the rearward parts of the lower portions of the laterally spaced swivel bracket members, and wherein the means joining the propulsion unit and the swivel bracket includes a king pin passing through the swivel block, and wherein the swivel bracket U-shaped frame is telescopically received within the transom bracket box-like frame.

In one embodiment in accordance with the invention, the marine propulsion device further includes a tilt and trim assembly connected to the swivel bracket and including a mounting bracket mounted to the transom bracket and located within the box-like frame and adjacent to the bottom thereof, a tilt cylinder-piston assembly having a first end pivotally connected to the mounting bracket about a first axis which is horizontal when the mounting bracket is fixed relative to the boat transom and having a second end pivotally connected to the swivel bracket, which tilt cylinder-piston assembly is operative, in response to extension and contraction thereof, to displace the swivel bracket relative to the transom bracket about the tilt axis, a trim cylinder-piston assembly including a cylinder having a blind end pivotally connected to the mounting bracket about a second axis parallel to the first axis, and a rod end, and a piston rod extending from the cylinder through the rod end and including an outer end adapted for engagement and disengagement with the swivel bracket, and means connecting the trim cylinder-piston assembly and the tilt cylinder-piston assembly for angularly displacing the trim cylinder-piston assembly about the second axis in response to angular movement of the tilt cylinder-piston assembly about the first axis occurring in response to extension and contraction of the tilt cylinder-piston assembly.

In one embodiment in accordance with the invention, the marine propulsion device further includes means for passing a control line and/or a supply line through a opening in the boat transom while maintaining watertight integrity comprising a mounting plate mounted to the transom bracket and in surrounding relation to the opening in the transom and located within the box-like frame above the mounting bracket.

In one embodiment in accordance with the invention, the means connecting the propulsion unit to the mounting portion of the swivel bracket includes a king pin extending in the swivel bracket and fixed to the propulsion unit, and means for rotatably displacing the king pin relative to the swivel bracket including an arm extending fixedly and laterally from the king pin and an expansible and contractable link pivotally connected to the arm and to the swivel bracket about axis parallel to the steering axis.

The invention also provides a marine installation comprising a boat hull having a transom with an upper edge and a marine propulsion device comprising a transom bracket including a mounting portion fixed to the rear of the boat transom below the upper edge, and a pair of laterally spaced arms extending upwardly from the mounting portion and including respective upper ends located rearwardly of the boat transom and above the upper edge thereof, a swivel bracket comprising a mounting portion and a pair of laterally spaced arms extending upwardly from the swivel bracket mounting portion and including respective upperends, means rearwardly of the transom and above the upper edge thereof and adjacent the upper ends of the transom bracket and swivel bracket arms for mounting the swivel bracket to the transom bracket for pivotal movement about a tilt axis which is horizontally located rearwardly of the transom and above the upper edge thereof when the transom bracket is boat mounted and between a running position with the swivel bracket mounting portion located adjacent the transom bracket mounting portion and a raised position, a propulsion unit including an internal combustion engine and a propeller mounted for rotation and driven by the engine, and means connecting the propulsion unit to the mounting portion of the swivel bracket for pivotal steering movement of the propulsion unit relative to theswivel bracket about a second axis transverse to the tilt axis and for common movement of the propulsion unit with the swivel bracket about the tilt axis and without travel of the propulsion unit over the transom upper edge or into engagement with the transom when the swivel bracket is in the raised position.

The invention also provides a marine propulsion device comprising a transom bracket adapted to be mounted on a boat transom, a swivel bracket, means pivotally connecting the swivel bracket to the transom bracket for pivotal movement of the swivel bracket relative to the transom bracket about a tilt axis which is horizontal when the transom bracket is boat mounted, a propulsion unit including an internal combustion engine and a propeller mounted for rotation and driven by the engine, means connecting the propulsion unit to the swivel bracket for common movement of the propulsion unit with the swivel bracket about the tilt axis and for pivotal steering movement of the propulsion unit relative to swivel bracket about a steering axis transverse to the tilt axis, and a trim and tilt assembly comprising a mounting bracket including means for detachable mounting thereof to the transom bracket, a tilt cylinder-piston assembly having a first end pivotally connected to the mounting bracket about a first axis which is horizontal when the mounting bracket is fixed relative to the boat hull and having a second end pivotally connected to the swivel bracket, which tilt-cylinder piston assembly is operative, in response to extension and contraction thereof, to displace the swivel bracket relative to the transom bracket about the tilt axis, a trim cylinder piston assembly including a cylinder having a blind end pivotally connected to the mounting bracket about a second axis parallel to the first axis and a rod end, and a piston rod extending from the cylinder through the rod end and including an outer end adapted for engagement and disengagement with the swivel bracket, and means connecting the trim cylinder-piston assembly and the tilt cylinder-piston assembly for angularly displacing the trim cylinder-piston assembly about the second axis in response to angular movement of the tilt cylinder-piston assembly about the first axis occurring in response to extension and contraction of the tilt cylinder-piston assembly.

The invention also provides a tilt and trim assembly adapted to form part of a marine propulsion device including a swivel bracket, which tilt and trim assembly comprises a mounting bracket adapted to be mounted to the rear of a boat transom, a tilt cylinder-piston assembly having a first end pivotally connected to the mounting bracket about a first axis which is horizontal when the mounting bracket is fixed relative to a boat transom and having a second end with means adapted for pivotal connection to the swivel bracket of the marine propulsion device, a trim cylinder-piston assembly including a cylinder having a blind end pivotally connected to the mounting bracket about a second axis parallel to the first axis, and a rod end, and a piston rod extending from the cylinder through the rod end and including an outer end adapted for engagement and disengagement with the swivel bracket, and means connecting the trim cylinder-piston assembly and the tilt cylinder-piston assembly for angularly displacing the trim cylinder-piston assembly about the second axis in response to angular movement of the tilt cylinder-piston assembly about the first axis.

The invention also provides apparatus for passing a control line and/or a fluid supply line through an opening in a boat transom while maintaining water-tight integrity, which apparatus comprises a mounting plate including a first surface having a peripheral portion adapted to be sealingly fixed to the margin around the opening in the boat transom and a second surface remote from the boat transom, and a fluid supply line extending through the mounting plate between the first and second surfaces, while maintaining water-tight integrity and including, adjacent one of the first and second surfaces, a fitting communicating with the supply line and adapted for detachable connection to a continuation of the fluid supply line.

The invention also includes apparatus for passing a control line and/or a fluid supply line through an opening in a boat transom while maintaining water-tight integrity, which apparatus comprises a mounting plate including a first surface having a peripheral portion adapted to be sealingly fixed to the margin around the opening in the boat transom, a second surface remote from the boat transom, and a central surface remote from the boat transom, and a central portion located inwardly of the peripheral portion and including therein a bore extending between the first and second surfaces, a control line passing through the bore, a grommet between the bore and the control line, and an anchor fixed to the central portion of the mounting bracket and engaging the grommet to sealingly engage the grommet between the control line and the central portion of the mounting bracket, whereby to provide water-tight integrity.

The invention also provides a marine propulsion device comprising a transom bracket adapted for mounting to a boat transom, a swivel bracket, means connecting the swivel bracket and the transom bracket for pivotal movement of the swivel bracket relative to the transom bracket about a tilt axis which is horizontal when the transom bracket is boat mounted, a propulsion unit including an internal combustion engine and a propeller mounted for rotation and driven by the engine, means connecting the propulsion unit to the swivel bracket for common movement of the propulsion unit with the swivel bracket about the tilt axis and for pivotal steering movement of the propulsion unit relative to the swivel bracket about a steering axis transverse to the tilt axis, which means includes a king pin extending in the swivel bracket and fixed to the propulsion unit, and means for rotatably displacing the king pin relative to the swivel bracket including an arm extending fixedly and laterally from the king pin and an extensible and contractable link pivotally connected to the arm and to the swivel bracket about axes parallel to the steering axis.

In one embodiment of the invention, the link comprises a hydraulic cylinder-piston assembly.

The invention also provides a marine propulsion device comprising bracket means adapted for mounting to the transom of a boat, means for pivotally connecting a propulsion unit to the bracket means for tilt movement about a tilt axis which is horizontal when the bracket means is boat mounted, a cylinder-piston assembly which is pivotally connected to the bracket means about a first axis parallel to the tilt axis and which is movable about the first axis in accordance with tilt movement of the propulsion unit, a variable resistor fixed on the bracket means and including a wiper having an arm adapted to engage the cylinder-piston assembly, means biasing the arm into engagement with said cylinder-piston assembly, and remote means electrically connected to the variable resistor for indicating the angle of tilt of the propulsion unit.

Other features and advantages of the embodiments of the invention will become known by reference to the following general description, claims and appended drawings.

IN THE DRAWINGS

Figure 1:
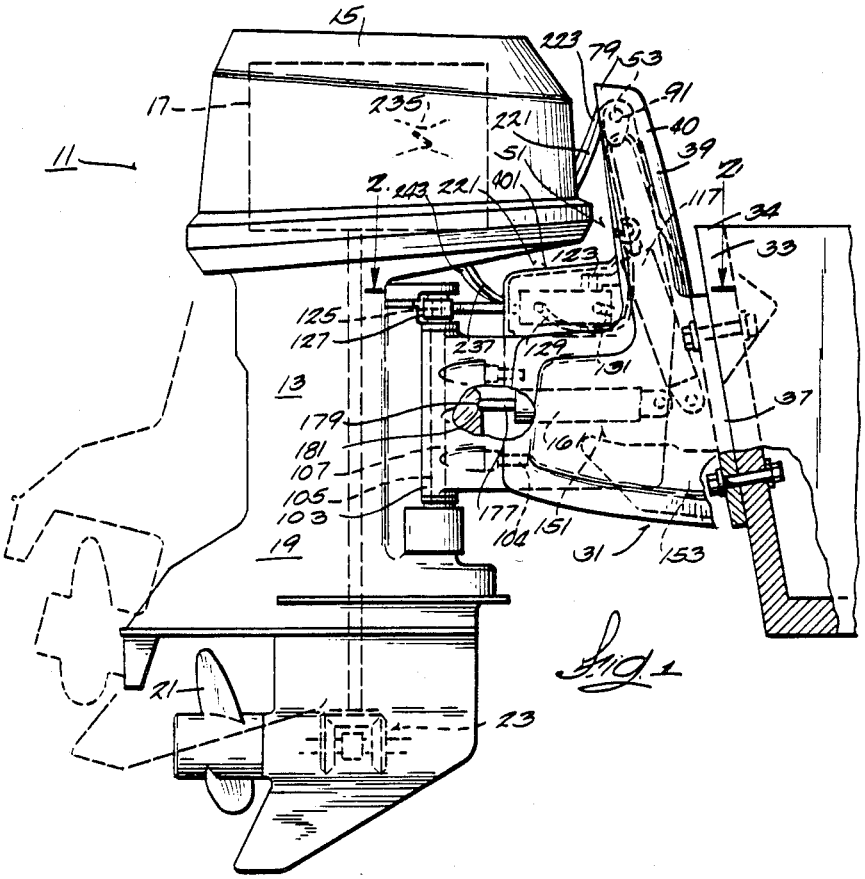
FIG. 1 is a side elevational view, partially broken away and in section, of a marine propulsion device incorporating various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion device which is in the form of an outboard motor 11 and which includes a generally conventional propulsion unit 13 incorporating a power head 15 with an internal combustion engine 17. The propulsion unit 13 also includes a lower unit 19 incorporating a rotatably mounted propeller 21 drivingly connected to the engine 17 through a selectively operable reversing transmission 23.

Figure 3:
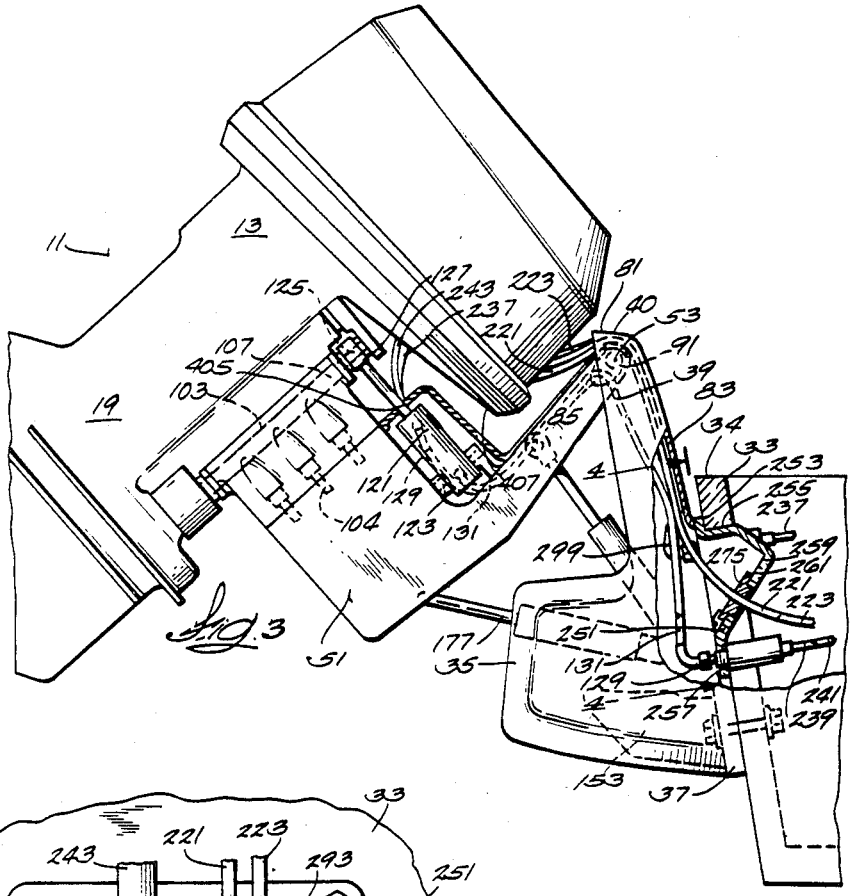
FIG. 3 is a fragmentary side elevational view, partially broken away and in section, of the marine propulsion device which is shown in FIG. 1 and which is illustrated in a fully raised position.

The outboard motor 11 also includes a mounting assembly 31 for mounting the propulsion unit 13 to the rear of a boat transom 33 such that the propulsion unit 13 is vertically swingable between (See FIG. 1) a lowermost running position with the propeller 21 submerged in water and (See FIG. 3) a fully raised position with the propeller 21 out of the water, and such that the propulsion unit 13 does not engage the transom 33 and/or travel forwardly over the top or upper edge 34 of the transom when the propulsion unit 13 is elevated to the fully raised position.

Figure 7:
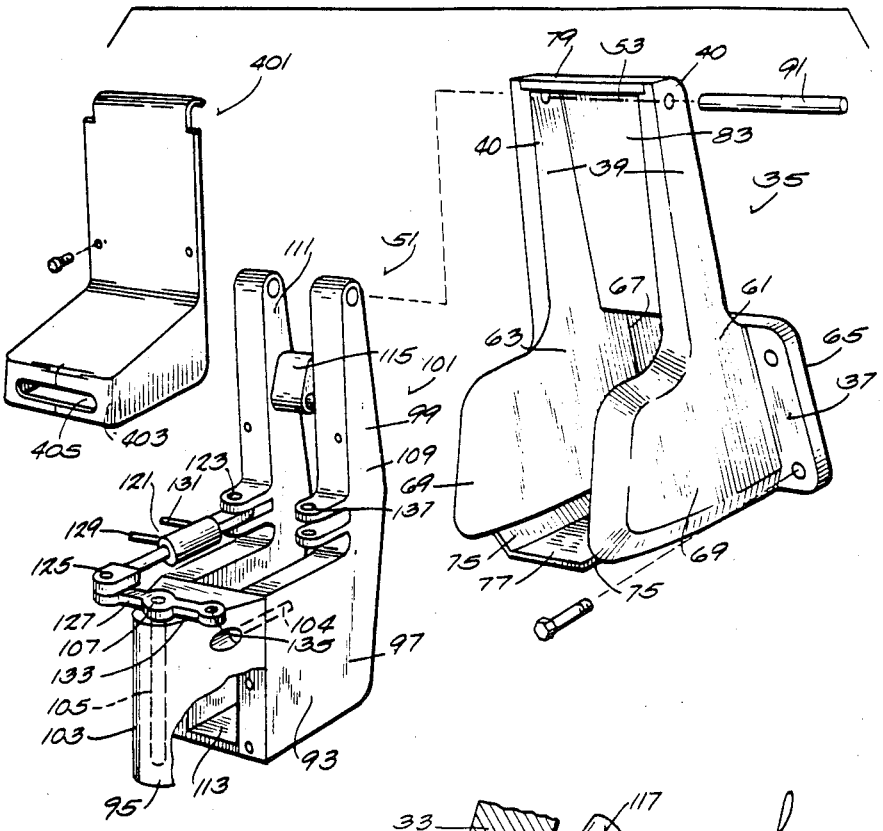
FIG. 7 is an enlarged, exploded perspective view of various of the components of the marine propulsion device shown in FIGS. 1 and 3.

The propulsion unit mounting assembly 31 comprises a transom bracket assembly 35 including (see FIGS. 1, 2 and 7) a mountig portion 37 adapted to be secured, by bolts or other suitable means, to the rear of the boat transom 33, and a pair of laterally spaced arms 39 extending upwardly from the mounting portion 37 and including an upper end 40 having means for pivotally mounting a swivel bracket assembly 51 for swinging movement of the swivel bracket assembly 51 about an axis 53 which is horizontal when the transom bracket assembly 35 is boat mounted and relative to the transom bracket assembly 35.

More particularly, while various arrangements can be employed, the transom bracket assembly 35 comprises (see especially FIG. 7) a pair of laterally spaced side members or legs 61 and 63 which respectively include forward surfaces 65 and 67 adapted to engage the boat transom 33 and which constitute part of the mounting portion 37.

The spaced side member 61 and 63 are generally L-shaped, each including a lower portion having a forward part including the surfaces 65 and 67 and a rearward part 69 extending rearwardly from the mounting portion 37 and having a substantial height corresponding, in general, to the height of the mounting portion 37, and a lower margin. The arms 39 extend upwardly and somewhat rearwardly from the lower portion.

The side members 61 and 63 are laterally connected at the top and bottom to provide a generally hollow, box-like frame or structure. More particularly, the side member 61 and 63 respectively include, along their lower margins, respective inwardly extending flanges 75 which are interconnected by a lower transverse reinforcing member or bottom plate 77 to transversely strengthen the bottom of the transom bracket assembly 35. At the top, the arms 39 are transversely connected by an upper transverse member in the form of an angle-like member 79 providing the transom bracket assembly 35 with a top wall 81 and forming a generally box-like frame having a hollow interior.

The forward margins of the arms 39 of the transom bracket assembly 35 above the mounting portion 37 are also transversely connected by a decorative cover 83 which covers or merges with the top wall 81.

While other arrangements could be employed, the means pivotally mounting the swivel bracket assembly 51 from the transom bracket assembly 35 comprises a suitable tilt pin 91 extending horizontally below the upper transverse member 79 and through the upper ends of the arms 39 of the transom bracket assembly 35 and through the upper end of the swivel bracket assembly 51.

The swivel bracket assembly 51 is also generally L-shaped and includes a lower horizontally extending leg 93 having a rearward part 95 and a forward part 97, together with a generally vertical leg 99 which extends upwardly from the forward part 97 of the lower leg 93. More particularly, while other constructions could be employed, in the illustrated construction, the swivel bracket assembly 51 comprises a U-shaped assembly 101 which provides the vertical leg 99 and the forward part 97 of the lower leg 93, and a swivel block or member 103 which is removably connected to the assembly 101 by a plurality of bolts 104 and which includes a vertical bore 105 adapted to receive a king pin 107 fixed to and formig a part of the propulsion unit 13.

Still more particularly, in the illustrated construction, the U-shaped assembly 101 comprises a pair of vertical side members 109 and 111 which are generally of L-shape and which are laterally spaced apart at a distance somewhat less than the spacing of the transom bracket side members 61 and 63. Adjacent their lower ends, the swivel bracket side members 109 and 111 are laterally connected by a bottom plate 113 which is located above the bottom plate 77 of the transom bracket assembly 35. Toward the upper end of the swivel bracket vertical leg 99, but below the tilt pin 91, the swivel bracket side members 109 and 111 are laterally connected by an upper bracket 115 which laterally strengthens the upper part of the U-shaped assembly 101 and which also provides an anchor for a tilt cylinder-piston assembly 117 still to be described (See FIG. 1).

When the propulsion unit 13 is in the running position, the swivel bracket assembly 51 is received within the hollow interior of the transom bracket assembly 35 with the swivel block 103 extending rearwardly therefrom.

The propulsion unit 13, as previously explained, is generally of conventional construction and includes the before-mentioned king pin 107 which extends through the swivel block bore 105 and which is suitably fixedly connected at the top and bottom, preferably through suitable rubber mounts (not shown) to the propulsion unit 13 so that rotary king pin movement in the swivel bracket bore 105 effects steering movement of the propulsion unit 13 about the rotary axis of the king pin 107.

Means are provided for effecting steering movement of the propulsion unit 13 relative to the swivel bracket assembly 51. While other arrangements can be employed, in the preferred and illustrated construction, such means comprises an extendable and contractable link which, preferably, is in the form of a hydraulic cylinder-piston assembly 121, which, at one end, is pivotally connected to a vertically extending stud 123 supported on the rear margin of one of the swivel bracket side members 109 and 111, and which, at the other end, is pivotally connected to a stud 125 extending from an arm 127 fixedly projected laterally from the king pin 107. Accordingly, supply of hydraulic fluid through opposed conduits 129 and 131, will serve to either contract or expand the hydraulic cylinder-piston assembly 121, and thereby effect steering movement of the propulsion unit 13 relative to the swivel bracket assembly 51 and therefor relative to the boat transom 33. Preferably, the king pin 107 includes, in addition to the laterally projecting arm 127, an oppositely and laterally extending arm 133 with a vertically extending bore 135 and the other of the swivel bracket side members 109 and 111 also includes a vertical extending bore 137 so that the steering hydraulic cylinder-piston assembly 121 may be selectively attached to either side of the fore and after centerline of the marine installation.

Means are provided for vertically swingably displacing the swivel bracket assembly 51, and therefore the propulsion unit 13, between the lowermost running position forming the lower end of a trim range (See FIG. 1) and the uppermost or raised position (See FIG. 3) forming the upper end of a tilt range which extends upwardly from the trim range.

While other constructions could be employed, in the illustrated construction, the means for vertically swingably displacing the swivel bracket assembly 51 comprises (See especially FIG. 6) an essentially self-contained tilt and trim assembly 151 including a mounting bracket 153 which is separately mountable by suitable means, such as bolts (not shown), to the mounting portion 37 of the transom bracket side members 61 and 63, adjacent to the bottom of the box-like transom bracket frame. The mounting bracket 153 supports an electrically operated reversible hydraulic fluid pump 155, together with a fluid flow hydraulic circuit or control system 157 (See FIG. 5) communicating with both the before-mentioned tilt cylinder-piston assembly 117 and a trim cylinder-piston assembly 161. The electrically operated pump 155 includes a motor 163 which extends inwardly through an opening 165 in the boat transom 33 and which is electrically connected to a battery or other source of power (not shown) forwardly of the boat transom 33.

Figure 2:
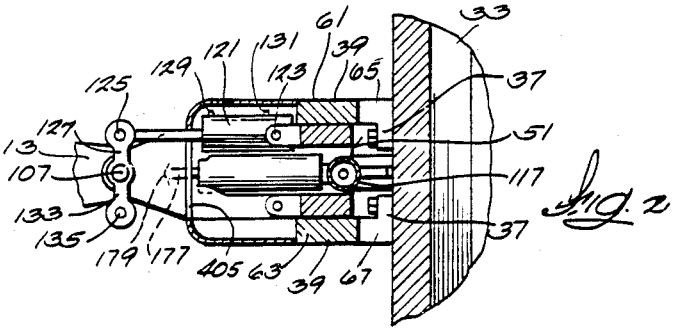
FIG. 2 is a fragmentary sectional view, taken generally along line 2—2 of FIG. 1.
Figure 6:
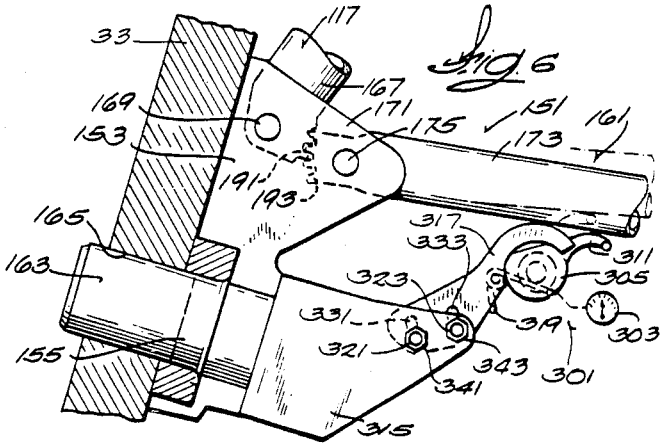
FIG. 6 is an enlarged fragmentary and partially schematic side elevational view, partially in section, of a portion of the device shown in FIG. 1.

More particularly, (as shown in FIGS. 1 and 6) the tilt cylinder-piston assembly 117 includes a tilt cylinder 167 and is pivotally connected, at one end, to a transverse mounting stud 169 extending horizontally and laterally between horizontally spaced arm portions 171 extending rearwardly on the mounting bracket 153 and is pivotally connected, at its other end, to the upper bracket 115 of the swivel bracket assembly 51.

The trim cylinder-piston assembly 161 includes a trim cylinder 173 and is pivotally mounted, at the blind end of the trim cylinder 173, to a transom mounting stud 175 extending between the horizontally spaced mounting bracket arm portions 171 in rearward parallel relation to the stud 169 pivotally connected to the tilt cylinder-piston assembly 117. Extending rearwardly from the other or rod end of the trim cylinder 173 is (See FIGS. 1 and 3) a piston rod 177 having an outer end 179 adapted for engagement with a socket 181 formed in the forward surface of the swivel block 103 and between the spaced swivel bracket side legs or members 109 and 111.

As the outer end 179 of the trim piston rod 177 is not fixedly pivotally connected to the swivel bracket assembly 51, as is the tilt cylinder-piston assembly 117, and in order to locate the outer end 179 of the trim piston rod 171 in position for engagement with the socket 181 as the swivel bracket assembly 51 swings vertically downwardly from the tilt range into the trim range, means are provided for angularly displacing the trim cylinder-piston assembly 161 in accordance with the angular movement of the tilt cylinder-piston assembly 117 which accompanies extension and contraction of the tilt cylinder-piston assembly 117. Accordingly, in the disclosed construction, the adjacent ends of the tilt cylinder 167 and trim cylinder 173 are respectively provided with gear segments 191 and 193 which are in intermeshing engagement so as to maintain the trim cylinder 173 and its trim piston rod 177 in alignment with the socket 181 in the swivel bracket block 103 during vertical swinging of the swivel bracket assembly 51 accompanying contraction and extension of the tilt cylinder-piston assembly 51.

Figure 5:
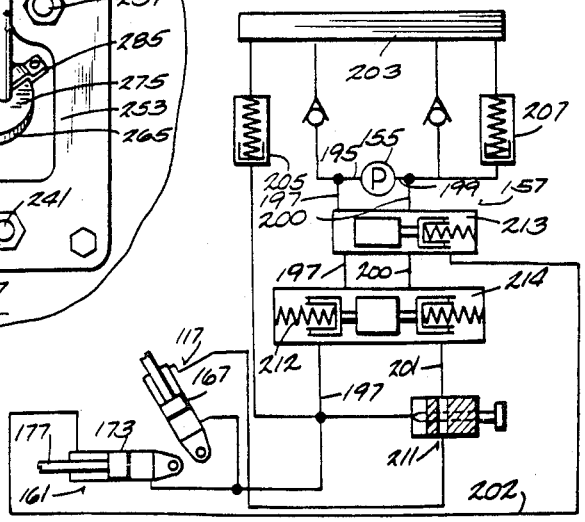
FIG. 5 is a schematic view of a hydraulic control circuit incorporated in the marine propulsion device shown in FIGS. 1 and 3.

The hydraulic control circuit 157 between the reversible electric pump 155 and the tilt and trim cylinder-piston assemblies 117 and 161 is shown in FIG. 5 and is generally of conventional construction. Briefly, the pump 155 includes a first discharge port 195 which is connected, through a first line or conduit 197 and through check valve 212, with the lower or adjacent ends of each of the tilt and trim cylinders 167 and 173. The pump 155 also includes a second discharge port 199 which is connected, through a second line or conduit 200, through check valve 213, and through a third conduit or line 202 with the other or outer end of the trim cylinder 173. In addition, the second discharge port 199 is connected, through conduit 200, through check valve 214, and through a fourth conduit or line 201, with the other or outer end of the tilt cylinder 167. The pump 155 is in fluid communication with a sump 203 which is supported by the mounting bracket 153. Pressure relief valves 205 and 207 are respectively connected between the first and second lines 197 and 200 and the sump 203. In addition, a manually operated releasing valve 211 affording fluid flow between the first and fourth lines 197 and 201 is provided in order to permit manual swinging displacement of the swivel bracket assembly 51 relative to the transom bracket assembly 35. It is particularly noted that, apart from securing of the mounting bracket 153 to the transom bracket assembly 35, the pivotal connection between the swivel bracket assembly 51 and the outer or upper end of the tilt cylinder-piston assembly 117 is the only connection with the other outboard motor components which is made or broken in connection with installation or replacement of the trim and tilt assembly 151.

Figure 4:
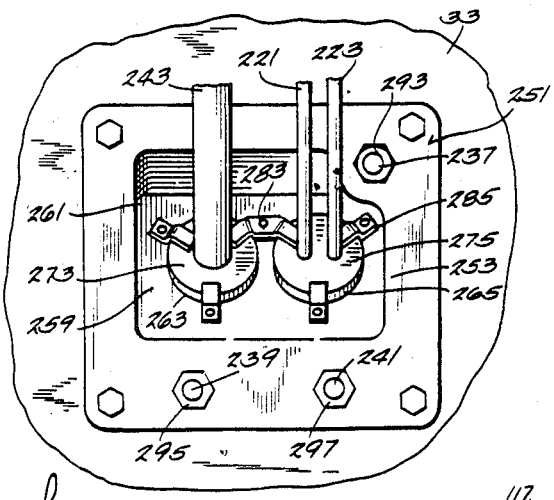
FIG. 4 is an enlarged fragmentary view taken generally along line 4—4 of FIG. 3.

Means are provided for passing control or supply lines in the form of control cables and conduits through the boat transom 33, while maintaining watertight integrity thereof, so as to facilitate passage of such control cables and conduits through the interior of the box-like transom bracket assembly 35, and with respect to at least some of the cables and conduits, to facilitate passage of control cables or conduits rearwardly of the front cover 83 and between the horizontal tilt pin 91 and the top wall 81 of the transom bracket assembly 35 and/or just below the horizontal tilt pin 91, and thence to connection with various of the components of the outboard motor. More specifically, in the disclosed construction, such cables and conduits include (See FIG. 4) push-pull cables 221 and 223, respectively connected to and controlling the engine throttle 235 and the reversing transmission 23, as well as a fuel line 237 and a pair of fluid conduits or supply lines 239 and 241 communicating with the steering cylider-piston assembly conduits 129 and 131 so as to control steering of the propulsion unit 13, and an electrical harness 243 which includes electrical connections between the propulsion unit 13 and a battery (not shown) and an ignition control. Less than all of the above cables and conduits or more than the above-enumerated cables and conduits can be passed through the boat transom 33.

While various other constructions could be employed, in the illustrated construction, the means for passing such cables and conduits through the boat transom 33 comprises a mounting bracket or plate 251 which is adapted to be mounted to the mounting portions 37 of the transom bracket assembly side member 61 and 63 between the transom bracket legs or side members 61 and 63 and in such manner as to sealingly engage the transom above the tilt and trim assembly mounting bracket 153. The mounting plate 251 includes an outer periphery or margin 253 which extends beyond the margin of a hole or opening 255 in the boat transom 33 through which the cables and conduits pass.

A gasket 257 is provided between the outer margin 253 of the mounting plate 251 and the boat transom 33 to maintain watertight integrity.

Still more particularly, the mounting plate 251 includes a central portion 259 which is located inwardly of the peripheral portion 253, which includes an inclined surface 261 extending upwardly and forwardly into the transom opening 255, and which includes a bore or opening 263 for upwardly and rearwardly inclined passage there-through of the electrical harness 243, as well as a bore or opening 265 for upward and rearward inclined passage there-through of the throttle and shift control cables 221 and 223. Suitable sealing means, such as respective grommets 273 and 275 engaging both the inclined surface 261 and the cables and/or conduits 243, 221 and 223, together with anchors 283 and 285 suitably connected to the mounting plae 251 and arranged to maintan the grommets 273 and 275 in sealing engagement with the lines 243, 221 and 223 and with the inclined surface 261 are provided so as to maintain water-tight integrity.

In connection with the fuel and hydraulic fluid steering connections, the fuel line 237 and the steering fluid conduit lines 239 and 241 are suitably connected to the mounting plate 251 and extend through the mounting plate 251 from the forward to the rearward surfaces thereof and forwardly of the boat transom 33. Provided on the mounting plate 251 and extending rearwardly are suitable respective nipples or fittings 293, 295, and 297 which communicate with the forwardly extending conduits 237, 239 and 241 and which are adapted to be connected to a rearwardly extending fuel line 299 connected to the engine 17 and to the hydraulic steering conduits 129 and 131.

It is also noted that the throttle cable 221, and the shift cable 223 extend upwardly and rearwardly behind the frontal wall or cover 83 and over the top of the tilt pin 91 and under the top wall 81 and thence to connections with the propulsion unit 13. The electrical harness 243, the fuel line 299, and the hydraulic steering conduits 129 and 131 extend upwardly and rearwardly behind the frontal wall or cover 83 and under the bottom of the tilt pin 91 being secured thereto by clamp 85, (See FIG. 4) and thence to connections with the propulsion unit 13.

Means 301 are also provided (See FIG. 6) for sensing and informing the operator of the angular tilt or trim position of the propulsion unit 13. Thus, in the disclosed construction, there is provided a remote indicator 303 which advises the operator of the angular position of the propulsion unit 13 within the trim range and which is electrcially connected to a sensing device in the form of a variable resistor or potentiometer 305 having a wiper forming an interior part of a pivotally mounted lever having an exteriorly located arm 311.

The senosr or resistor 305 is supported on a bracket member 315 which is fixed on the mounting bracket 153 of the tilt and trim assembly 151 either directly or through other components fixed to the mounting plate 153. More particularly, the sensor or resistor 305 is fixedly mounted on a leg 317 which, in turn, if fixed to the bracket member 315 so that the outer end of the arm 311 engages the under surface of the trim cylinder 173. Preferably, the lever or arm 311 is baised by a suitable spring 319 into engagement with the undersurface of the trim cylinder 173. Thus, angular movement of the trim cylinder 173 about the axis of the mounting stud 175 in response to angular movement of the propulsion unit 13 about the tilt axis 53 results in positioning of the arm 311 in accordance with the position of the propulsion unit 13 and provides for a suitable indication at the remote indicator 303.

It is believed that electrical circuits for connecting the indicator 303 and sensor or resistor 305 are well known in the art and need not be described.

In order to accomodate mounting on boat transoms having different angles with respect to the vertical, the arrangement for mounting the leg 317 to the bracket member 315 includes spaced first and second bolt holes 321 and 323, respectively, in one of the bracket member 315 and the leg 317, together with spaced first and second slots 331 and 333, respectively, in the other of the bracket member 315 and the leg 317, and a pair of bolts 341 and 343 which are insertable through the first and second bolt holes 321 and 323 and through the first and second slots 331 and 333 in order to vary the attitude of the leg 317 to accomodate boats having different transom angles.

Alternatively, the bracket member 315 or leg 317 could be fixed to the transom bracket assembly 35. In addition, if desired, the resistor arm 311 could be supported from the transom bracket assembly 35 or swivel bracket assembly 51 for engagement with the tilt cylinder 167.

In order to enclose at least some of the control cables or lines 221, 223, 237, 239, 241, and 243 and to substantially enclose the tilt cylinder 117 as well as the cylinder of the steering cylinder-piston assembly 121 during normal running orientation of the propulsion unit 13, the swivel bracket assembly 51 includes (See FIG. 7) rear covers 401 and 408 which, together with the laterally spaced side members 99 and 111, constitutes a swivel bracket housing. The rear covers 401 and 408 extend transversely between the upwardly extending side members 99 and 111 and, near the lower end thereof, also extends rearwardly to substantially enclose the cylinder of the steering cylinder-piston assembly 121. The rear covers include, at the rearward end thereof, lower vertical walls 403 including horizontally extendig slots 405 through which extend the piston rod of the steering cylinder-piston assembly 121, as well as the fuel line 237 and the electrical harness 243. The fuel line 237 and electrical harness 243 enter into the power head 15 through the bottom pan 407 of the power head 15 in the area above the steering axis or king pin bore 105 so as to minimize movement of the fuel line 237 and electrical harness 243 during steering action.

The throttle and shift control cables 221 and 223 exit from the rear of the swivel bracket housing adjacent the top and at one side thereof to facilitate connection thereof to the usual connections provided in prior outboard motor constructions.

In summary, the marine propulsion device 11 includes a propulsion unit 13 which is adapted to be swung upwardly from a lowered running position (See FIG. 1) to a raised position (See FIG. 3) without engaging the boat transom 33 or passing forwardly over the top edge 34 thereof. In addition, the arrangement for trimming and tilting the propulsion unit 13 includes an essentially self-contained tilt and trim assembly 151 which is mounted on the transom bracket assembly 35. Still further in addition, the various cables and conduits which control operation of the marine propulsion device 11 are passed through the boat transom opening 255 by means of the plate 251 which is also mounted to the transom bracket assembly 35 and above the tilt and trim assembly 161. Thus, the disclosed propulsion unit 13 neither engages the boat transom 33 or travels over the top edge 34 thereof during tilting. Nor do any control cables or supply conduits pass over the top edge 34 of the boat transom 33 in route to the marine propulsion device 11.

If desired, the mounting bracket 153 of the tilt and trim assembly 151 could be mounted directly to the boat transom independently of the transom bracket assembly 35, as could the mounting plate 251.

Various of the features of the invention are set forth in the following claims.

I claim:

1. An outboard motor comprising a transom bracket adapted for mounting to a boat transom, a swivel bracket, means connecting said swivel bracket and said transom bracket for pivotal movement of said swivel bracket relative to said transom bracket about a tilt axis which is horizontal when said transom bracket is boat mounted, a propulison unit including an internal combustion engine and a propeller mounted for rotation and driven by said engine, means connecting said propulsion unit to said swivel bracket for common movement of said propulsion unit with said swivel bracket about said tilt axis and for pivotal steering movement of said propulsion unit relative to said swivel bracket about a steering axis transverse to said tilt axis, and means for rotatably displacing said propulsion unit relative to said swivel bracket including an extensible and contractable link located below said tilt axis and pivotally connected to said propulsion unit and to said swivel bracket about axes parallel to said steering axis.

2. An outboard motor comprising a transom bracket adapted for mounting to a boat transom, a swivel bracket having a generally vertical leg with an upper end, a lower portion, and a rearward portion located below said upper end, and a generally horizontal leg extending rearwardly from said lower portion of said vertical leg below said rearward portion and including a rearward part, means connecting said upper end of said swivel bracket and said transom bracket for pivotal movement of said swivel bracket relative to said transom bracket about a tilt axis which is horizontal when said transom bracket is boat mounted, a propulsion unit including a rotatable propeller, means connecting said propulsion unit to said rearward part of said horizontal leg of said swivel bracket for common movement of said propulsion unit with said swivel bracket about said tilt axis and for pivotal steering movement of said propulsion unit relative to said swivel bracket about a steering axis transverse to said tilt axis, and means for rotatably displacing said propulsion unit relative to said swivel bracket including an extensible and contractable link pivotally connected to said propulsion unit and to said rearward portion of said vertical leg of said swivel bracket about axes parallel to said steering axis.

3. An outboard motor comprising a transom bracket adapted for mounting to a boat transom, a swivel bracket having a rearwardly located part, means connecting said swivel bracket and said transom bracket for pivotal movement of said swivel bracket relative to said transom bracket about a tilt axis which is horizontal when said transom bracket is boat mounted, a propulsion unit including an internal combustion engine, a propeller mounted for rotation, and a drive shaft driven by said engine and connected to said propeller, means connecting said propulsion unit to said swivel bracket for common movement of said propulsion unit with said swivel bracket about said tilt axis and for pivotal steering movement of said propulsion unit relative to said swivel bracket about a steering axis located in transverse relation to said tilt axis, in rearwardly spaced relation from said tilt axis, and in forwardly spaced relation from said drive shaft, and an extensible and contractable link pivotally connected to said propulsion unit forwardly of said drive shaft and about an axis parallel to said steering axis, and to said rearward part of said swivel bracket and below said tilt axis and about an axis parallel to said steering axis, whereby to enable displacement of said propulsion unit about said steering axis and relative to said swivel bracket.

* * * * *